US005695409A

United States Patent [19]

Jackson

[11] Patent Number: 5,695,409

[45] Date of Patent: Dec. 9, 1997

[54] GOLF CLUB WITH OPENING AT BASE OF THE HEAD

[76] Inventor: Michael D. Jackson, 8060 Scotch Meadows Dr., Laurinburg, N.C. 28353

[21] Appl. No.: 606,478

[22] Filed: Mar. 4, 1996

[51] Int. Cl.[6] ..... A63B 53/02; A63B 53/04

[52] U.S. Cl. ..... 473/305; 473/317; 473/327

[58] Field of Search ..... 473/324, 305, 473/307, 309, 310, 313, 314, 315, 316, 317, 327

[56] References Cited

U.S. PATENT DOCUMENTS

| | | | |
|---|---|---|---|
| D. 83,077 | 1/1931 | Sussams | D21/220 |
| D. 217,873 | 6/1970 | Steele | 473/305 |
| D. 361,358 | 8/1995 | Simmons | D21/220 |
| 780,776 | 1/1905 | Brown | 473/327 |
| 1,133,129 | 3/1915 | Govan | 473/337 |
| 1,414,124 | 4/1922 | Griffin | 473/327 |
| 1,543,636 | 6/1925 | Williamson | 473/306 |
| 1,892,482 | 2/1932 | Cash | 473/305 |
| 1,952,624 | 3/1934 | Imman et al. | |
| 4,147,357 | 4/1979 | Strop | |
| 4,795,153 | 1/1989 | Thomas | 473/316 |
| 5,056,788 | 10/1991 | Katayama | |
| 5,158,296 | 10/1992 | Lee | 473/327 |
| 5,326,106 | 7/1994 | Meyer | 473/305 |
| 5,447,307 | 9/1995 | Antonious | |

FOREIGN PATENT DOCUMENTS

| | | | |
|---|---|---|---|
| 322635 | 12/1929 | United Kingdom | 273/169 |
| 2 230 461 | 10/1990 | United Kingdom | |
| 2 240 933 | 8/1991 | United Kingdom | |

*Primary Examiner*—Sebastiano Passaniti

*Attorney, Agent, or Firm*—Bell, Seltzer, Park & Gibson, P.A.

[57] ABSTRACT

A golf club, comprising a head having a striking face, a front toe, a rear heel, and opposing top and bottom edges. The club also includes a shaft joined to the heel of the head, and so as to define a juncture portion therebetween. Also at least one opening is formed through the juncture portion so as to define a pair of spaced branches on opposing sides of the opening.

9 Claims, 2 Drawing Sheets

GOLF CLUB WITH OPENING AT BASE OF THE HEAD

BACKGROUND OF THE INVENTION

The present invention relates to a golf club which is configured to provide improved accuracy and consistency in the golfer's impact with the ball.

Conventional golf clubs come in a wide variety of configurations and propose a variety of techniques to attempt to provide advantages for the golfer. Typical advantages include clubs which are more forgiving or more powerful to improve the range and distance obtained from a golf swing. For example, U.S. Pat. No. 5,447,307 issued to Antonious entitled Golf Club With Improved Anchor-Back Hosel discloses an anchor-back or offset shaft wherein the lower part of the hosel is mounted on the rear cavity of the club head adjacent the heel portion of the head. The extra weight of this lower hosel design is placed behind the striking face. The Antonious patent proposes that this configuration will provide a more solid and more forgiving shot pattern because of the extra mass behind the club face.

U.S. Pat. No. 5,056,788 issued to Katayama entitled Club Set with Progressively Altered Hosel Thickness and Head Weight proposes placing weighted portions in a recess over a rear surface of the club head in order to improve the efficiency of the swing and resulting hit.

U.K. Patent No. 2,240,933 issued to MacGregor Golf Company entitled Golf Irons discloses placing a planar segment on the sole to cause the head to sit squarely and a support column in the backside cavity aligned with the center of mass to reduce the hollow sound generated from a swing and hit.

Each of the conventional golf clubs discussed above proposes to improve the game of golf by providing golf clubs with forgiving off center hits or better structural or functional characteristics to improve a golfer's game.

OBJECTS AND SUMMARY OF THE INVENTION

It is an object of the invention to improve conventional golf clubs by providing a structurally simple modification of otherwise conventional clubs and which serves to provide an enlarged sweet spot for the club, which in turn acts to improve the accuracy and consistency of the golfer's impact with the ball.

The above and other objects and advantages of the present invention are achieved by the provision of a golf club which comprises a head having a striking face, a front toe, a rear heel, and opposing top and bottom edges. The club also includes a shaft joined to the heel of the head and so as to define a juncture portion therebetween. Further, at least one opening is formed through the juncture portion and so as to extend therethrough in a direction extending generally perpendicular to the striking face.

It is believed that positioning at least one opening in a golf club head at the described location, will enlarge the sweet spot of the hitting surface. By enlarging the sweet spot, the ability of the golfer to accurately and consistently impact the ball, will be improved. The opening can be standardized across a set, and even across different sets, but is more preferably to be customized depending on a particular club configuration in order to maximize the sweet spot on each type of club.

In a preferred embodiment, a single opening extends through the juncture portion, and this single opening may for example be configured to include a substantially parabolic edge portion and a substantially vertical edge portion. Alternatively, the single opening may be of substantially circular outline, and in another embodiment, the opening has the configuration of a narrow slot which is in the form of a shallow, inverted C.

In still another embodiment, a plurality of separate openings are provided, such as a pair of openings which are separated by an intermediate span which is integral with the juncture portion.

BRIEF DESCRIPTION OF THE DRAWINGS

Other objects and advantages will appear as the description proceeds when taken in connection with the accompanying drawings, in which.

DETAILED DESCRIPTION OF THE INVENTION

Figure 1:
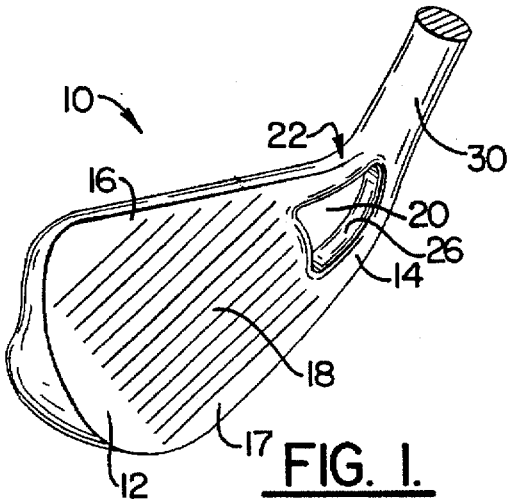
FIG. 1 illustrates a front perspective view of a golf club according to a first embodiment of the present invention.
Figure 2:
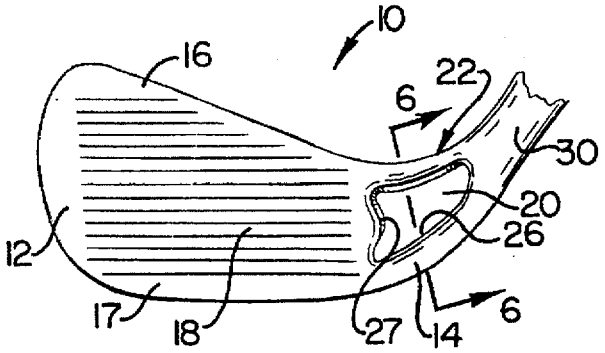
FIG. 2 illustrates a front elevation view of a golf club according to a first embodiment of the present invention.
Figure 3:
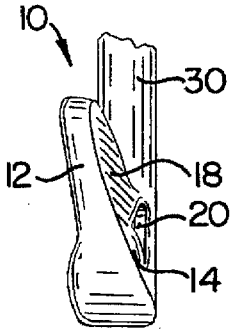
FIG. 3 illustrates a toe end elevation view of a golf club according to a first embodiment of the present invention.
Figure 4:
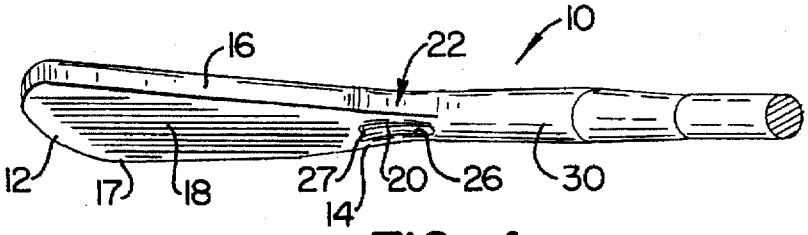
FIG. 4 illustrates a top plan view of a golf club according to a first embodiment of the present invention.
Figure 5:
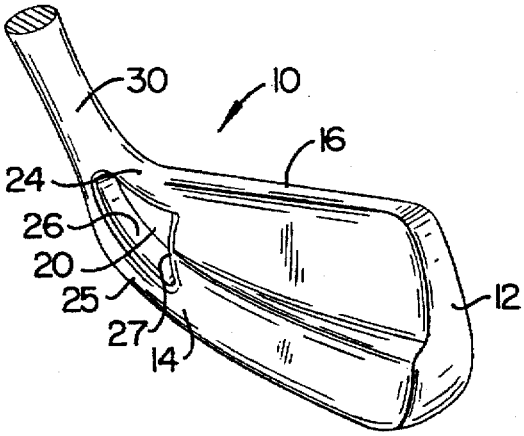
FIG. 5 illustrates an angled rear perspective view of a golf club according to a first embodiment of the present invention.

The present invention now will be described more fully hereinafter with reference to the accompanying drawings in which preferred embodiments of the invention are shown. This invention may, however, be embodied in many different forms and should not be construed as limited to the illustrated embodiments set forth herein; rather, these illustrated embodiments are provided so that this disclosure will be thorough and complete and will fully convey the scope of the invention to those skilled in the art. Like numbers refer to like elements throughout.

For ease of discussion, the golf club as illustrated and described herein will be exemplified by a mid range iron, but it will be understood that the same principles are applicable to all of the normal irons, the woods, and putters. FIGS. 1–6 illustrate a first embodiment of a golf club head 10 which embodies the present invention, and which comprises a front toe 12, a rear heel 14, a front striking face 18 and opposing top and bottom edges 16, 17. An elongate shaft 30 is attached to the heel 14 and so as to define juncture portion 22 therebetween, and with the shaft being of sufficient length so that it may be gripped by the golfer in the usual manner. A single opening 20 extends through the juncture portion 22 in a direction generally perpendicular to the striking face 18. The opening 20 in the juncture portion 22 defines opposing branches which are positioned generally above and below the opening 20, forming a top branch 24 and a bottom branch 25.

Figure 6:
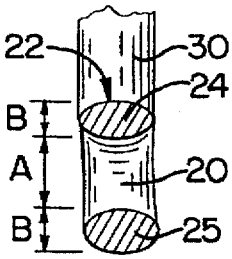
FIG. 6 illustrates a longitudinal sectional view taken along line 6—6 of FIG. 2 of a golf club according to a first embodiment of the present invention.

As best seen in FIG. 6, the branches 24 and 25 are of like cross-sectional configuration and they are of substantially equal cross-sectional area. Also, the branches are vertically spaced apart a distance A which is equal to about twice the cross-sectional vertical dimension B of each branch.

In the embodiment of FIGS. 1–6, the opening 20 is of a generally D-shaped configuration in outline, and it includes a substantially parabolic edge portion 26 which faces toward the rear heel 14 of the head, and a substantially vertical edge portion 27 which is positioned immediately adjacent the heel. Also in this embodiment, the opening 20 has a transverse dimension which is larger than the vertical dimension.

Figure 7:
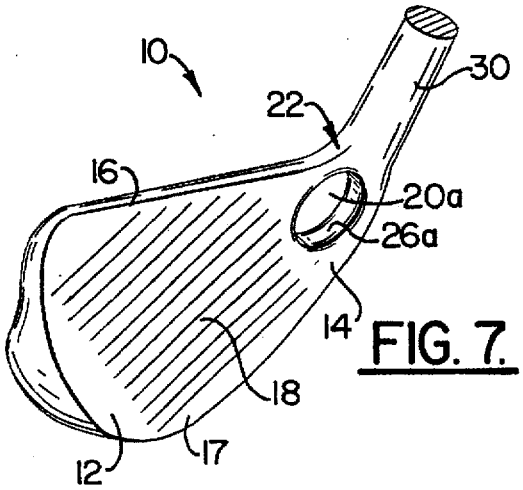
FIG. 7 illustrates an angled front perspective view of a golf club according to a second embodiment of the present invention.
Figure 8:
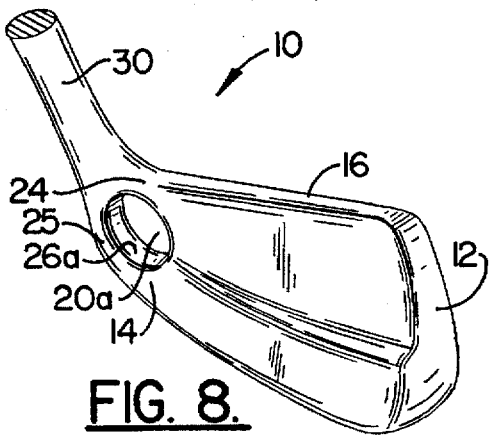
FIG. 8 illustrates an angled rear perspective view of a golf club according to the second embodiment of the present invention.
Figure 9:
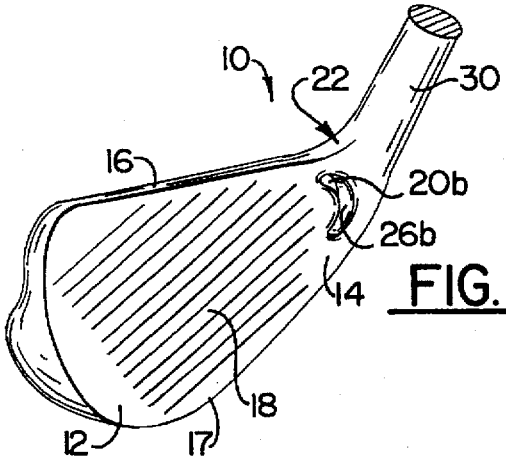
FIG. 9 illustrates a front perspective view of a golf club head according to a third embodiment of the present invention.

In the embodiment of FIGS. 7 and 8, the opening 20*a* is of substantially circular outline. FIG. 9 illustrates another embodiment, wherein the opening 20*b* is in the form of a generally vertically extending narrow slot which has the configuration of a shallow inverted C.

Figure 10:
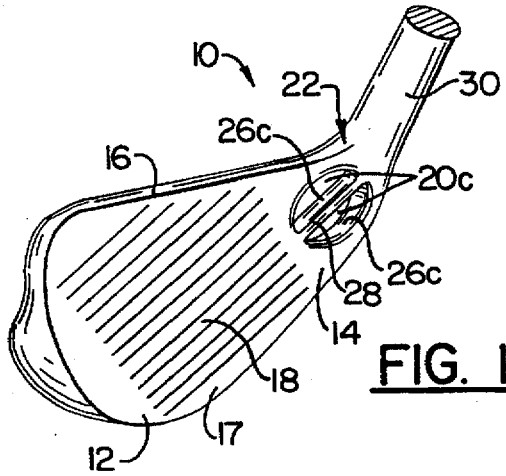
FIG. 10 illustrates a front perspective view of a golf club head according to a fourth embodiment of the present invention.

FIG. 10 illustrates still another embodiment wherein a pair of openings 20*c* is provided, with the openings 20*c* being separated by an intermediate span 28 which is integral with the juncture portion.

The shaft 30 is conventionally joined with the head 10 as known in the art. Typically this attachment includes a metal hosel portion which can be integral with the head, but can include other attachment methods as is known in the art.

The branches 24, 25 may be manufactured to be thicker in the transverse plane of the cross section, (i.e., the depth dimension) to compensate for any structural weakness introduced by the opening 20 by providing compensating rigidity into the configuration. This may become necessary as the size of the opening 20 or number of openings employed is increased. Obviously, it is important to maintain enough material in the juncture portion 22 to provide adequate shear and tensile strength as well as torsional resistance in the club.

The position, size, shape and quantity of the opening(s) 20 in the juncture portion of the head 10 are all variables which can be selected based upon the configuration and design of the particular club.

The size of the opening 20 varies with the number of openings employed and the position of the openings in the juncture portion. It is believed that an opening as small as 2.5 $mm^2$ in surface area may provide a resulting increase in the size of the sweet spot, although an area for the opening(s) of at least about 2.5 $mm^2$ is preferred. In the embodiments of FIGS. 1–8, the opening preferably has an area of at least about 1 $cm^2$. In the embodiment of FIG. 10, the pair of openings collectively have an area of at least about 1 $cm^2$. It is expected that the opening 20 will optimally be much smaller than the cross-sectional area of a golf ball, and preferably less than about 3 $cm^2$, so as to minimize functional or structural problems such as loss of strength or loss in torsion resistance which under certain conditions can be caused by an opening 20.

The position and size of an opening 20 alters the center of gravity of the club and with it the club's moment of inertia. Although a standardized opening could be formed in the club(s), it is preferred that an opening be customized to maximize the sweet spot for each different club configuration. Therefore, a typical customized club will have an opening 20 positioned to reflect its individual structural parameters. Some important parameters include but are not limited to, club weight, head and juncture material, head and juncture size and shape, and the like.

The opening 20 can be formed in the head 10 by any number of conventional techniques, such as by die casting, drilling, reaming, boring, punching, or the like. The opening 20 can also subsequently be enlarged by filing, redrilling, or the like.

The rear face of the head 10 is not limited by the configuration of the opening and can employ any conventional configuration as known in the art. The rear face may also employ any suitable strengthening means to strengthen the juncture portion 22 as necessary, such as but not limited to, a bracket support member, an extra layer of material, or the like. The strengthening means can be attached to the juncture portion 22 according to conventional means such as but not limited by rivets, weld or braze.

In the drawings and specification, there have been disclosed typical preferred embodiments of the invention, and, although specific terms are employed, these terms are used in a descriptive sense only and not for purposes of limitation. The invention has been described in considerable detail with specific reference to various illustrated embodiments. It will be apparent, however, that various modifications and changes can be made within the spirit and scope of the invention as described in the foregoing specification and defined in the appended claims.

That which is claimed is:

1. A golf club, comprising:

a head having a striking face, a front toe, a rear heel, and opposing top and bottom edges;

an elongate shaft joined to the rear heel of said head and so as to define a juncture portion therebetween, and a single opening formed through said juncture portion so as to extend in a direction which is generally perpendicular to said striking face, said single opening being positioned at least substantially below the elevation of the top edge of the head and so as to define a pair of spaced branches on opposing sides of the opening, with the spaced branches being of substantially equal cross-sectional area, and wherein said spaced branches are vertically spaced apart a distance which is at least equal to about twice the cross-sectional vertical dimension of each of said spaced branches.

2. A golf club as defined in claim 1 wherein said single opening includes a substantially parabolic edge portion and a substantially vertical edge portion, with the substantially vertical edge portion being positioned immediately adjacent the rear heel of the head.

3. A golf club as defined in claim 1 wherein said single opening is of substantially circular outline.

4. A golf club as defined in claim 1 wherein said single opening has the configuration of a generally vertically extending narrow slot.

5. A golf club as defined in claim 4 wherein the narrow slot has the configuration of a shallow inverted C.

6. A golf club as defined in claim 1 wherein said single opening has transverse and vertical dimensions, with the transverse dimension being larger than the vertical dimension.

7. A golf club as defined in claim 1 wherein said single opening has an area of at least about 1 $cm^2$.

8. A golf club, comprising:

a head having a striking face, a front toe, a rear heel, and opposing top and bottom edges;

an elongate shaft joined to the rear heel of said head and so as to define a juncture portion therebetween, a single opening formed through said juncture portion so as to extend in a direction which is generally perpendicular to said striking face, with said opening being positioned at least substantially below the elevation of the top edge of the head and so as to define a pair of spaced branches on opposing sides of said opening, with the spaced branches being vertically spaced apart a distance which is at least equal to about twice the cross-sectional vertical dimension of each of said spaced branches, and said opening having an area of at least about 1 $cm^2$.

9. A golf club as defined in claim 8 wherein said spaced branches are of substantially equal cross-sectional area.

* * * * *